US007052210B2

(12) United States Patent
Kurdziel

(10) Patent No.: US 7,052,210 B2
(45) Date of Patent: May 30, 2006

(54) INLET COLLAR FOR HIGHWAY CULVERTS

(75) Inventor: John M. Kurdziel, Fort Wayne, IN (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 0 days.

(21) Appl. No.: 10/852,037

(22) Filed: May 24, 2004

(65) Prior Publication Data

US 2005/0260039 A1 Nov. 24, 2005

(51) Int. Cl.
*E01F 5/00* (2006.01)

(52) U.S. Cl. ..... 405/125; 405/127

(58) Field of Classification Search ..... 405/42, 405/124–126, 127; 285/334.1, 334.3, 903
See application file for complete search history.

(56) References Cited

U.S. PATENT DOCUMENTS 4,993,872 A 2/1991 Lockwood
5,308,123 A * 5/1994 Zorn ..... 285/226
5,536,113 A 7/1996 McGregor
5,765,534 A * 6/1998 Brown et al. ..... 123/470
6,079,749 A * 6/2000 Albino et al. ..... 285/23
6,203,245 B1 3/2001 Harten

* cited by examiner

*Primary Examiner*—Sunil Singh
(74) *Attorney, Agent, or Firm*—Kremblas, Foster, Phillips & Pollick

(57) ABSTRACT

A highway culvert inlet collar is disclosed having a plate member and a pipe adapter. The plate member has a front face, a rear face, a peripheral side edge intermediate the front face and the rear face, and a tapered inlet face portion adjacent the front face. The front face has a front face effective width at least twice that of the tapered inlet face portion effective width of the tapered inlet face portion. The pipe adapter has a first end and a second end, an interior surface and an exterior surface. The front face has an interior edge and an exterior edge. The tapered inlet face portion is located centrally of the front face and is preferably angled 45° rearwardly from the front face. The pipe adapter is preferably oriented perpendicularly to the rear face. The tapered inlet face portion extends from the front face interior edge to a tapered face interior edge. The pipe adapter is attached to the plate member intermediate the peripheral side edge and the tapered face interior edge. The collar is also disclosed in combination with plastic pipe, preferably corrugated.

17 Claims, 3 Drawing Sheets

INLET COLLAR FOR HIGHWAY CULVERTS

BACKGROUND OF THE INVENTION

1. Field Of The Invention

This invention relates generally to highway culverts, and more particularly, to an inlet collar for use with corrugated pipe, and even more particularly to a collar used in conjunction with corrugated plastic pipe.

2. Description Of The Related Art

This invention is directed to the providing of an inlet collar for improving flow characteristics when used in conjunction with corrugated pipe, with such pipe being, in the preferred embodiment, fabricated from plastic or other similar material well known in the art of pipe fabrication. Tubular steel culverts are well known in the art, as are culverts which utilize concrete pipe.

Where a stream or the runoff from a agricultural field ditch is to pass under a roadway, there are generally two alternatives which may be employed to permit the water to pass under the roadway. The first is the construction of a bridge, which allows full water passage at gravity flow conditions, but can be extremely expensive, especially in applications where the culvert to be crossed is relatively narrow. The other alternative is the use of a culvert system, which tends to pond water at the culvert inlet creating head pressure.

Some culvert systems utilize precast concrete culvert pipe or corrugated metal pipe that extend under the width of the road to pass flow through the roadway embankment. At the opposing ends of the aligned sections may be placed respective pairs of concrete wingwalls, headwalls, or end sections which can assist with the controlling of water flow through the culvert and to prevent the erosion of the ground near the ends of the aligned culvert sections and improve flow characteristics.

Associated with some such culvert systems is a concrete footer on which the aligned culvert sections and wingwalls rest. A contractor can pour cast-in-place wingwalls following the alignment of the precast culvert sections. To retain the wingwall atop a footer, a series of steel reinforcing rods extend upwardly into the upright portion of a wingwall. However, utilization of such systems consumes time and money. For example, utilizing cast-in-place wingwalls typically consumes one to two weeks of additional construction time, with this time associated with the pouring and curing of the four wingwalls. Alternative solutions featuring precast wingwalls are disclosed in U.S. Pat. No. 4,993,872 and in U.S. Pat. No. 5,536,113.

As mentioned above, some culvert systems utilize steel tubing, with U.S. Pat. No. 6,203,245 to Harten disclosing a culvert end guard preferably fabricated from concrete for use with steel pipe to preclude breakage or deformation where the pipe terminates directly adjacent an open culvert of course, the use of concrete pipes would arguably preclude the need for a concrete culvert end guard.

More recently, culvert design has incorporated the use of plastic pipe, especially corrugated plastic pipe. In theory, this change is desirable, since the cost of culvert design using plastic pipe can be a fraction of the cost using concrete pipe. Another way to reduce the cost of the culvert design is to simplify the inlet, for example by eliminating the use of wingwalls, thereby using the end of the pipe as the inlet for the culvert. However, as will be appreciated from the discussion set forth below, the entrance loss coefficients associated with many such existing systems have been too high. Additionally, in order to obtain equivalent flows, plastic pipes have had to be of a greater diameter than concrete pipes, a condition that has often caused the concrete pipe to be chosen due to the perceived benefit of being able to use a smaller diameter pipe.

It is thus apparent that the need exists for an inlet collar for highway culverts which results in a culvert system having an improved entrance loss coefficient, and which is relatively easy and cost effective to fabricate and install in conjunction with plastic pipe, especially corrugated plastic pipe.

SUMMARY OF THE INVENTION

In accordance with the present invention, there is disclosed a highway culvert inlet collar having a plate member and a pipe adapter. The plate member has a front face, a rear face, a peripheral side edge intermediate the front face and the rear face, and a tapered inlet face portion adjacent the front face. The front face has a front face effective width and the tapered inlet face portion has a tapered inlet face portion effective width, with the front face effective width being at least twice the tapered inlet face portion effective width. The pipe adapter has a first end and a second end, as well an interior surface and an exterior surface, with the pipe adapter being attached to the plate member. Preferably the pipe adapter is cylindrical. In the preferred embodiment of the invention, the front face effective width is twice the tapered inlet face portion effective width.

The front face has an interior edge and an exterior edge. The tapered inlet face portion is located centrally of the front face. The tapered inlet face portion is preferably angled 45° rearwardly from the front face. The pipe adapter is preferably oriented perpendicularly to the rear face. The tapered inlet face portion extends from the front face interior edge to a tapered face interior edge. The pipe adapter is attached to the plate member intermediate the peripheral side edge and the tapered face interior edge.

There is also disclosed in combination, a pipe and a highway culvert inlet collar, with the collar having a plate member and a pipe adapter. The plate member has a front face, a rear face, a peripheral side edge intermediate the front face and the rear face, and a tapered inlet face portion adjacent the front face. The front face has a front face effective width and the tapered inlet face portion has a tapered inlet face portion effective width, with the front face effective width being at least twice the tapered inlet face portion effective width. The pipe adapter has a first end and a second end, as well as an interior surface and an exterior surface. The pipe adapter is attached to the plate member and the pipe is attached to the collar. In the preferred embodiment of the invention, the pipe adapter first end is attached to the rear face.

The front face has an interior edge and an exterior edge. The tapered inlet face portion is located centrally of the front face. In the preferred embodiment of the invention the tapered inlet face portion extends rearwardly from the front face interior edge to a tapered face interior edge at an angle of 45°. The pipe is secured to the pipe adapter interior surface. The front face effective width is twice the tapered inlet face portion effective width. The pipe preferably is corrugated and fabricated of plastic.

The primary objective of this invention is to provide a highway culvert inlet collar with an excellent entrance loss coefficient.

Another objective of this invention is to provide such a device which is relatively easy to install in its operative position.

Still another objective of this invention is to be able to efficiently get water into a pipe.

Other objects and advantages of the invention will be apparent from the following description, the accompanying drawings and the appended claims.

Figure 1:
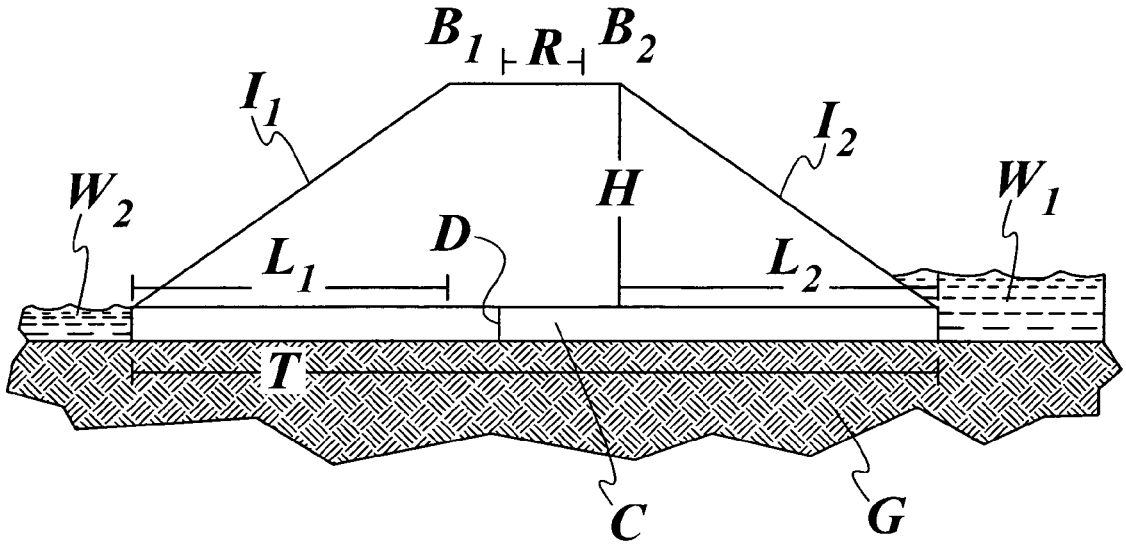
FIG. 1 is a schematic view of a highway culvert system in general.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Having reference to the drawings, attention is directed first to FIG. 1, which discloses in schematic form some of the engineering considerations associated with the installation of a highway culvert. When it is necessary to drain land adjacent a road, highway culverts provide a means to transfer water from one side of a road to the other, thus keeping the water away from the road surface. If water is not transported away from the roadway, the presence of the water can undercut the road, leading to deterioration and the potential of collapse.

Consequently, the role of highway culverts in preserving the integrity of road systems cannot be underestimated. For example, at sites where bridges are erected, associated with that bridge may be anywhere from ten to thirty pipes laid under the ground on opposing sides of the bridge. Furthermore, the amount of pipe utilized at each location where a highway culvert exists is considerable.

To better understand the quantity of pipe utilized in conjunction with a single culvert for example, FIG. 1 discloses a hypothetical road R having berms B1 and B2, with the road R being elevated above the location of culvert C by a height H. The culvert C installed in ground G permits water to flow in the appropriate direction between W1 and W2. The diameter D associated with the pipe of a highway culvert can vary from 24"–96" depending on the amount of water flow that a particular culvert is designed to accommodate. The ratio of the lengths L1 and L2 of the culvert system which extend beneath the tapered, inclined sides, I1 and I2 respectively, of the roadway to the height H can vary from 2:1 to 20:1 depending on the specific guidelines which must be followed. For purposes of this hypothetical illustration, L1 and L2 are shown as being ten times the distance associated with the height of the road above the culvert, in other words a 10:1 taper. Assuming the road R is 50' wide, and berms B1 and B2 are each 10' wide, the length of pipe required to be used in a culvert is not 70', because of the taper.

Taking the taper into account, if the road R is elevated above the culvert site C by a hypothetical height H of 15', then the lengths of the culvert system L1 and L2 extending under the inclined sides I1 and I2 respectively would each be 150', based on the 10:1 taper ratio. Thus, in this particular example, the total length T of pipe to be used in this single culvert is 370'. Realizing that there could be as many as thirty culverts associated with each bridge provides an idea of how much pipe is used in conjunction with highway culverts in modern roadway design.

An important factor in the design of highway culverts is the ability to get water into the pipe. This factor takes into account the entrance loss coefficient associated with the design of the inlet end of the pipe. Several different designs have been associated with the various types of pipe in the past.

Figure 2:
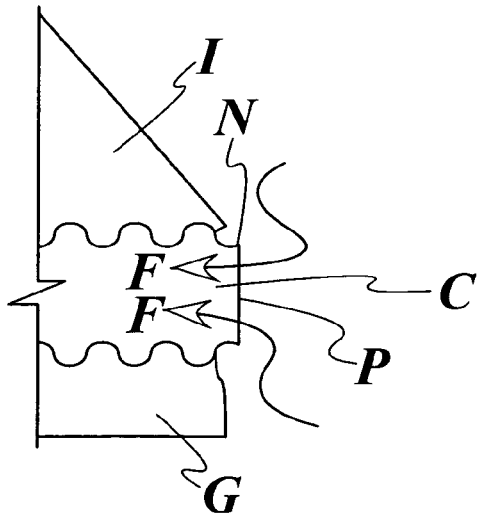
FIG. 2 (Prior Art)
FIG. 2 is a schematic of a first type of prior art inlet.

One prior art design for pipe inlets is shown in FIG. 2. The culvert C is in ground G adjacent the tapered side I of a roadway (not shown). The pipe P that is shown is corrugated, such as metal or plastic. In this type of prior art design, the pipe projects generally horizontally from the fill (i.e. ground) into the area where water accumulates, so as to permit flow F. The thin edge N associated with the projecting corrugated pipe creates turbulence regardless of where the corrugated pipe is cut, such that the entrance loss coefficient is 0.9, a value that is rather high.

Figure 3:
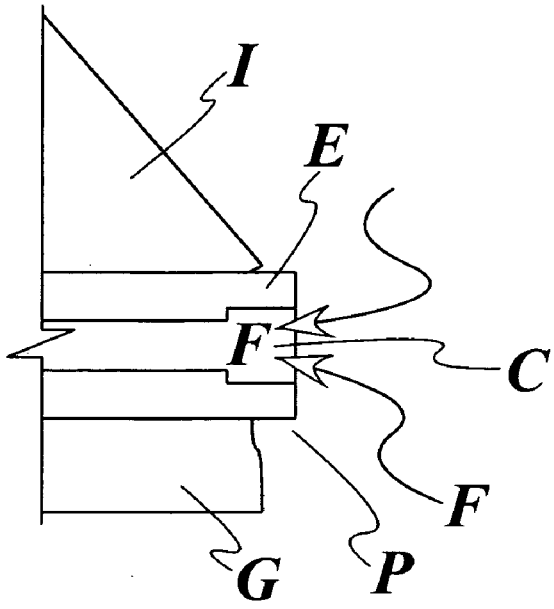
FIG. 3 (Prior Art)
FIG. 3 is a schematic of a second type of prior art inlet.

Another prior art design for pipe inlets is shown in FIG. 3 and is associated with concrete pipe. Once again, the culvert C is in ground G adjacent the tapered side I of a roadway (not shown). As the pipe P is laid beginning at the outlet end (not shown) of the culvert, one section of pipe's spigot is inserted into the bell of a previously laid pipe, such that the terminal end of the culvert features a pipe end E which serves as the inlet through which there is water flow F. The entrance loss coefficient associated with this concrete pipe inlet design is a much more desirable 0.2. Furthermore, there is no reason to cut the projecting portion of the pipe so that it exhibits a square cut end, since the entrance loss coefficient of a square cut end of concrete pipe is 0.5, which is less desirable than the aforementioned entrance loss coefficient of 0.2, plus to cut the pipe would involve more work.

The entrance loss coefficients associated with similarly designed concrete versus plastic pipe have favored concrete pipe. For example, in order to have the same flow as that which is associated with 24" concrete pipe, it may be necessary to use 36" plastic pipe, which creates a perceived advantage for concrete pipe.

Figure 4:
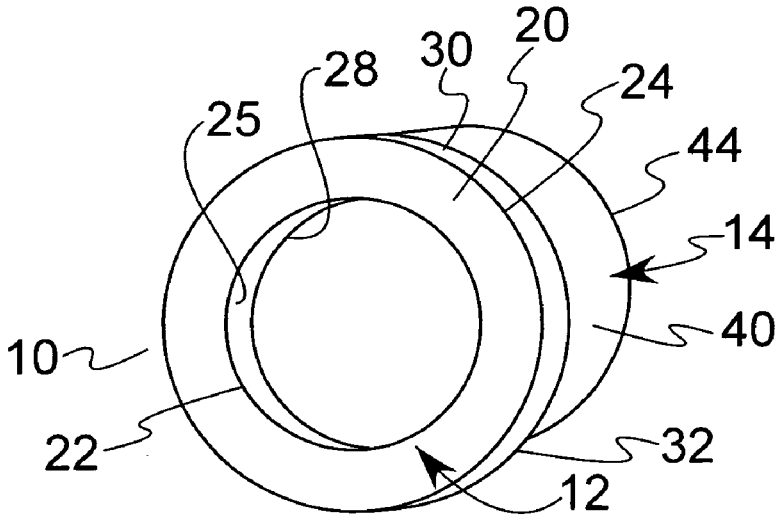
FIG. 4 is a perspective view of a highway culvert inlet collar embodying the invention.
Figure 5:
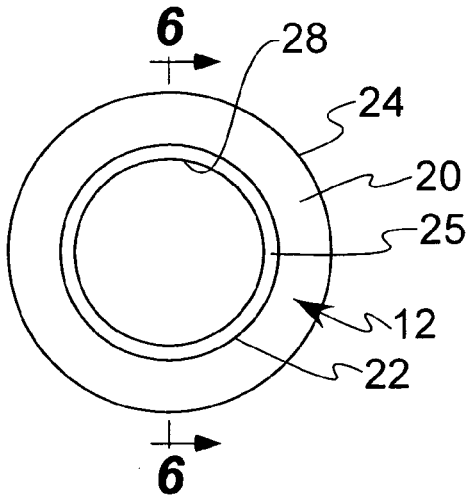
FIG. 5 is a front elevational view of the inlet collar.
Figure 6:
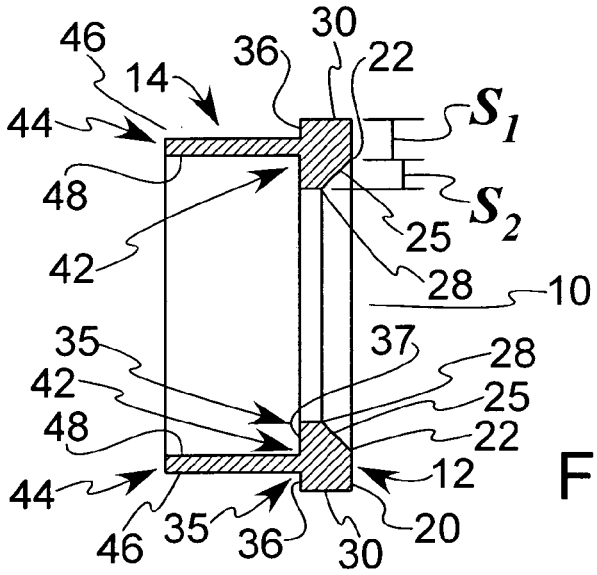
FIG. 6 is a vertical sectional view taken along line 6—6 of FIG. 5.

FIG. 4 discloses a highway culvert inlet collar made in accordance with the invention, designated generally by the numeral 10. In comparing FIG. 4 with FIGS. 5 and 6, it will be appreciated that the collar 10 has a plate member 12 to which is attached a pipe adapter 14. The plate member 12 has a front face 20, having an interior edge 22 and an exterior edge 24. The distance $S_1$ between the interior edge 22 and the exterior edge 24 is of a ratio of at least 1" for every 1' of the inner diameter of the pipe 60 used with the inlet collar. The front face dimension $S_1$ results in the front face 20 neutralizing the incoming flow, thereby obviating the creation of turbulence at the entrance to the pipe.

The plate member also has a tapered inlet face portion 25 and a peripheral side edge 30. The tapered inlet face portion 25 extends from the interior edge 22 of the front face 20 to the tapered face interior edge 28. The angle of taper between the front face 20 and the tapered inlet face portion 25 is preferably 45°. The distance $S_2$ representing the perpendicular distance between the interior edge 22 and the tapered face interior edge 28 is of a ratio of 1/2" for every 1' of the inner diameter of the pipe 60 used with the inlet collar 10. The relationship between $S_1$ and $S_2$ can also be expressed as the distance $S_1$ associated with the effective width of the front face being at least twice that of $S_2$ which is the effective width of the tapered inlet face portion (and in the preferred embodiment is exactly twice that of $S_2$).

The plate member 12 also has a rear face 35, having a rear face first portion 36 that is adjacent the peripheral side edge 30, and a rear face second portion 37 that is adjacent the tapered face interior edge 28. The peripheral side edge 30 that extends from the front face 20 to the rear face first portion 36 is of a length sufficient to prevent the bending of the peripheral portion of the plate member. Any bending of the plate member due to headwater pressure could adversely affect the desired flow pattern.

As can be appreciated from a comparison of FIGS. 4, 5, 6, and 7, the pipe adapter 14 component of the inlet collar 10 has a first end 42 and a second end 44, and an exterior surface 46 and an interior surface 48. Preferably the pipe adapter 14 has a circular cross-section in order to accommodate a cylindrical pipe, preferably corrugated and also preferably plastic. The pipe adapter first end 42 is attached to the rear face 35 of the plate member 12. The tapered face interior edge 28 is preferably spaced a distance inwardly from the interior surface 48 of the pipe adapter 14.

Figure 7:
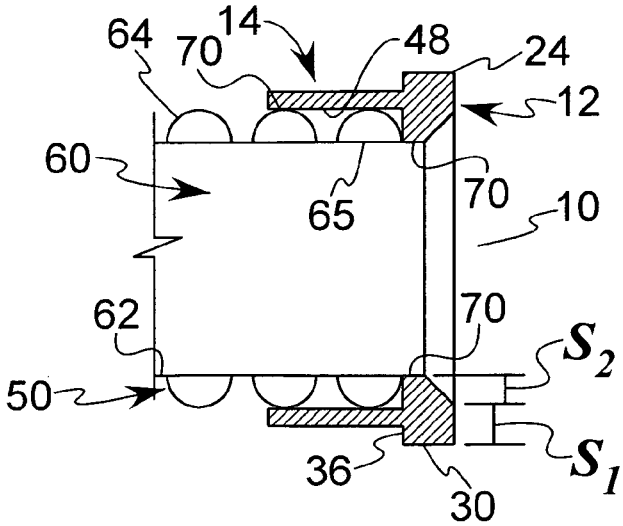
FIG. 7 is a vertical sectional view similar to FIG. 6, but showing the inlet collar in an operative embodiment.

In actual use, the inlet collar 10 is placed over the end of pipe 60 as can be seen in FIG. 7, the pipe 60 having an interior surface 62 corresponding to the inner diameter of the pipe, an exterior surface 64, and a pipe first end 65. It will be appreciated that in the operative embodiment of the invention, the pipe first end 65 is placed adjacent the rear face second portion 37 of the inlet collar 10, such that the interior surface 48 of the pipe adapter is adjacent the exterior surface 64 of the pipe 60, and the tapered face interior edge 28 is substantially coplanar with the inner diameter of the pipe. The length of the tapered face interior edge must be thick enough so that it is not possible to bend the juncture of the tapered face interior edge and the tapered inlet face portion with headwater pressure. The inlet collar is secured to the pipe by fastening means 70, which could be any suitable way of holding the pipe to the adapter, such as but not limited to by adhesive or by spot welding the adjacent surfaces. Additionally, the tapered face interior edge is preferably secured to the first end of the pipe by fastening means 70, which could be any suitable way of holding the pipe to the adapter, such as but not limited to by adhesive or by spot welding.

The highway culvert inlet collar made in accordance with this invention has an entrance loss coefficient of 0.2. Consequently, the diameter of the plastic pipe able to be used as a consequence of this invention can be the same diameter as had the choice for pipe been concrete. This results in a significant savings in labor as well as cost, over both concrete pipe of the same diameter and plastic pipe of a larger diameter which heretofore was often used in order to achieve equivalent flow with concrete pipe.

While the form of apparatus herein described constitutes a preferred embodiment of the present invention, it is to be understood that the invention is not limited to this precise form of apparatus and that changes may be made therein without departing from the scope of the invention which is defined in the appended claims.

What is claimed is:

1. A highway culvert inlet collar comprising a plate member, said plate member having a front flow contacting face, a rear face, a peripheral side edge intermediate said front flow contacting face and said rear face, and a tapered inlet face portion adjacent said front flow contacting face, said front flow contacting face having a front flow contacting face effective width and said tapered inlet face portion having a tapered inlet face portion effective width, said front flow contacting face having a substantially constant width, and said tapered inlet face portion having a substantially constant width, said front flow contacting face effective width being at least twice said tapered inlet face portion effective width, and a pipe adapter, said pipe adapter having a first end and a second end, said pipe adapter having an interior surface and an exterior surface, said pipe adapter being attached to said plate member, said pipe adapter being dimensioned to accommodate a pipe having a diameter of at least 24".

2. The collar according to claim 1 wherein said pipe adapter is cylindrical.

3. The collar according to claim 1 wherein said front flow contacting face has an interior edge and an exterior edge.

4. The collar according to claim 3 wherein said tapered inlet face portion extends from said front flow contacting face interior edge to a tapered face interior edge.

5. The collar according to claim 4 wherein said pipe adapter is attached to said plate member intermediate said peripheral side edge and said tapered face interior edge.

6. The collar according to claim 1 wherein said tapered inlet face portion is located centrally of said front flow contacting face.

7. The collar according to claim 1 wherein said tapered inlet face portion is angled 45° rearwardly from said front flow contacting face.

8. The collar according to claim 1 wherein said pipe adapter is oriented perpendicularly to said rear face.

9. The collar according to claim 1 wherein said pipe adapter being dimensioned to accommodate a pipe having a diameter in the range between 24" and 96".

10. In combination, a pipe and a highway culvert inlet collar, said pipe having a diameter of at least 24", said collar comprising a plate member and a pipe adapter, said plate member having a front flow contacting face, a rear face, a peripheral side edge intermediate said front flow contacting face and said rear face, and a tapered inlet face portion adjacent said front flow contacting face, said front flow contacting face having a front flow contacting face effective width and said tapered inlet face portion having a tapered inlet face portion effective width, said front flow contacting face having a substantially constant width, and said tapered inlet face portion having a substantially constant width, said front flow contacting face effective width being at least twice said tapered inlet face portion effective width, said pipe adapter having a first end and a second end, said pipe adapter having an interior surface and an exterior surface, said pipe adapter being attached to said plate member, said pipe being attached to said collar.

11. The combination of claim 10 wherein said pipe adapter first end is attached to said rear face.

12. The combination according to claim 10 wherein said front flow contacting face has an interior edge and an exterior edge.

13. The combination according to claim 12 wherein said tapered inlet face portion extends rearwardly from said front flow contacting face interior edge to a tapered face interior edge at an angle of 45°.

14. The combination according to claim 10 wherein said tapered inlet face portion is located centrally of said front flow contacting face.

15. The combination according to claim 10 wherein said pipe is secured to said pipe adapter interior surface.

16. The combination according to claim 10 wherein said pipe is corrugated and fabricated of plastic.

17. The combination according to claim 10 wherein said pipe has a diameter in the range between 24" and 96".

* * * * *